United States Patent [19]

Morishige

[11] 4,373,821

[45] Feb. 15, 1983

[54] ELECTRONIC TIMEPIECE GENERATING DIFFERENT ALARM SOUNDS FOR RESPECTIVE DIFFERENT REGIONS

[75] Inventor: Morio Morishige, Hachioji, Japan

[73] Assignee: Casio Computer Co., Ltd., Tokyo, Japan

[21] Appl. No.: 175,505

[22] Filed: Aug. 5, 1980

[30] Foreign Application Priority Data

Aug. 24, 1979 [JP] Japan ..... 54-108302

[51] Int. Cl.[3] ..... G04B 19/22; G04B 23/02; G04C 19/00

[52] U.S. Cl. ..... 368/21; 368/73; 368/82; 368/245; 368/261

[58] Field of Search ..... 368/21, 22, 72–74, 368/82–84, 239–242, 250, 251, 260

[56] References Cited

U.S. PATENT DOCUMENTS

| | | | |
|---|---|---|---|
| 4,104,865 | 8/1978 | Sasari | 368/261 X |
| 4,272,836 | 6/1981 | Tamaru et al. | 368/94 |
| 4,274,151 | 6/1981 | Kamiwaki | 368/21 |
| 4,300,221 | 11/1981 | Oda et al. | 368/22 |
| 4,301,524 | 11/1981 | Koerp et al. | 368/261 |

FOREIGN PATENT DOCUMENTS

| | | |
|---|---|---|
| 53-22465 | 3/1978 | Japan . |
| 53-66264 | 6/1978 | Japan . |
| 53-110567 | 9/1978 | Japan . |

*Primary Examiner*—Vit W. Miska

*Attorney, Agent, or Firm*—Frishauf, Holtz, Goodman & Woodward

[57] ABSTRACT

An electronic timepiece has a display unit capable of displaying different times in two or more regions in the world, an alarm time setting circuit capable of setting alarm times in the respective regions, and a buzzer device for sounding, at alarm times, different alarm sounds associated with the respective regions.

6 Claims, 5 Drawing Figures

ELECTRONIC TIMEPIECE GENERATING DIFFERENT ALARM SOUNDS FOR RESPECTIVE DIFFERENT REGIONS

BACKGROUND OF THE INVENTION

The present invention relates to an electronic timepiece for displaying different times in a plurality of regions in the world.

There has been developed an international timepiece for displaying times in major cities of countries in the world, and an alarm timepiece for sounding alarm sounds of an alarm time such as a present time or time just corresponding to digits on the dial of the timepiece.

A proposal to incorporate an alarm function into the international timepiece capable of displaying times in a plurality of regions in a switching manner is made. Such as international timepiece has an alarm time memory circuit and produces an alarm sound when a time of a specific region displayed coincides with an alarm time stored in the alarm memory circuit.

When using the electronic timepiece with such a construction one knows only an alarm time in the region displayed. For this reason, when a person in Tokyo wants to have an alarm sound at AM 8:00 in New York, the time display must be set to the New York time. Therefore, the Tokyo time is not displayed till the alarm sound in New York is produced. This is very inconvenient. Additionally, to know the region related to an alarm sound produced, one must check it, or the region selected, after seeing the display.

Accordingly, an object of the present invention is to provide an electronic timepiece to allow one to easily know the region by merely hearing an alarm sound produced with different alarm sounds correspondingly related to regions.

SUMMARY OF THE INVENTION

To achieve the above object, there is provided an electronic timepiece having display means for displaying times in a plurality of regions with different times, alarm time setting means for setting an alarm time; and sounding means for sounding different alarm sounds for the respective regions when the times in the plurality of regions is coincident with an alarm time set by the alarm setting means.

With such a construction, an alarm sound related to a desired region is obtained. In addition, one can discriminate alarm sounds associated with the regions merely through hearing the alarm sounds.

DETAILED DESCRIPTION

Figure 1:
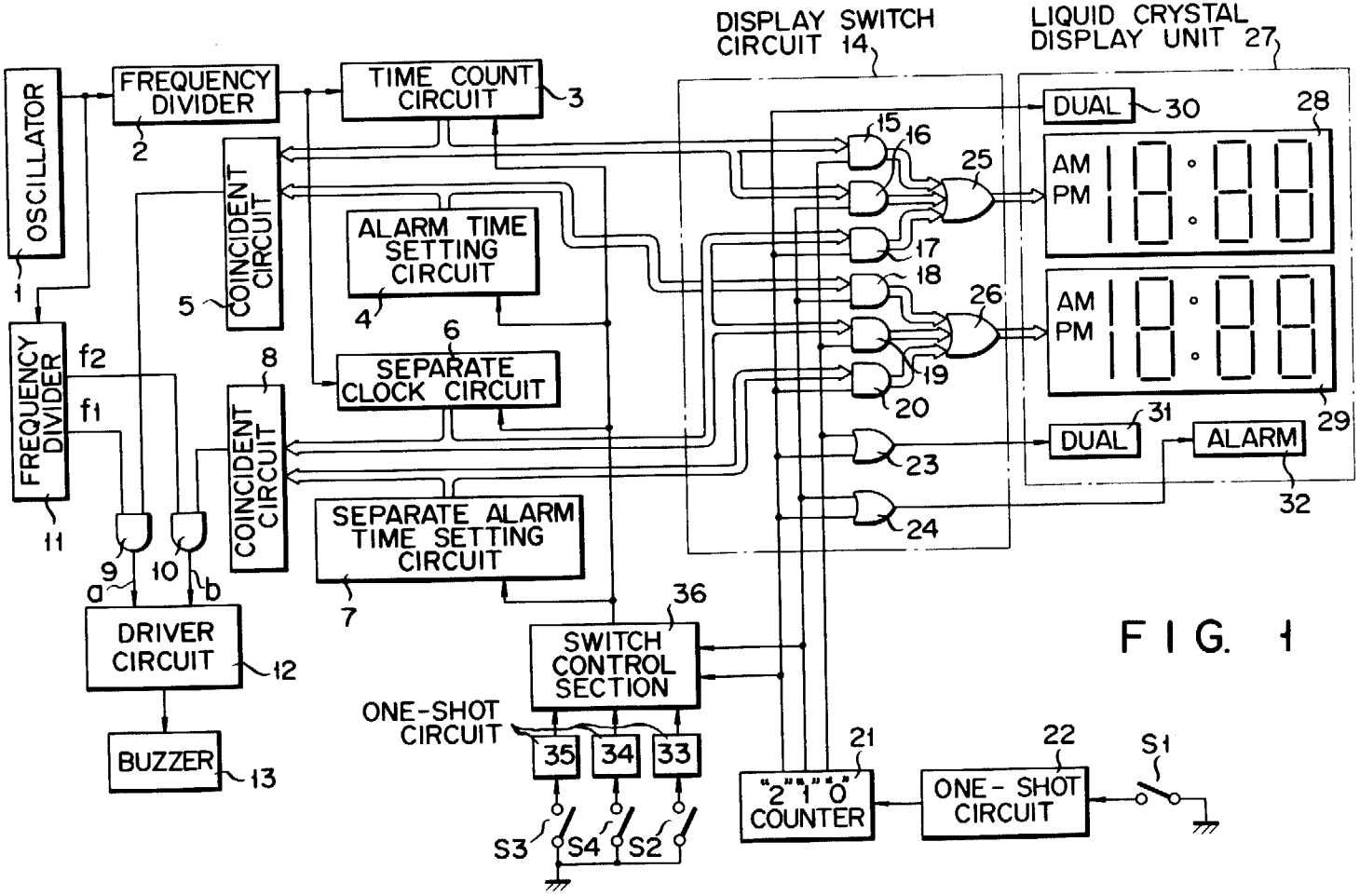
FIG. 1 is a circuit construction of an embodiment of a timepiece according to the present invention.

FIG. 1 is a circuit diagram of an electronic timepiece to which the invention is applied. In FIG. 1, reference numeral 1 designates an oscillator providing a fundamental frequency of 32.768 KHz which is applied to a frequency divider 2. The frequency divider 2 frequency-divides the fundamental frequency into a basic clock signal with a period of one second which in turn is applied to a time count circuit 3. The time count circuit 3 counts time data such as hour and minute. The time data counted is applied to a coincident circuit 5 supplied with alarm setting time data from an alarm time setting circuit 4. The one-second signal outputted from the frequency divider 2 is applied to a separate clock circuit 6, too. The separate clock circuit 6 provides time data of another region, i.e. separate time data, different in time from a region of which the time is currently counted by the time count circuit 3 by using the basic signal of one-second period from the frequency divider 2. The separate time data is applied from the separate clock circuit 6 to a coincident circuit 8 supplied with alarm time setting data from a separate alarm time setting circuit 7. The alarm time setting circuits 4 and 7 store the alarm time setting data inputted through the operation of an external switch to be given later. The coincident circuit 5 compares time data delivered from the time count circuit 3 and the alarm time setting circuit 4. When both the data are coincident with each other, the coincident circuit 5 applies a coincident signal as a gate control signal to one input terminal of an AND circuit 9. Similarly, another coincident circuit 8 compares the time data from the separate clock circuit 6 and the separate alarm time setting circuit 7. When both are coincident with each other, it produces a coincident signal which in turn is applied as a gate control signal to one input terminal of an AND circuit 10. The AND circuits 9 and 10 are supplied at the other input terminals with different frequency signals f1 and f2 derived from a frequency divider 11. Those frequency signals f1 and f2 are applied to a buzzer circuit 13 through AND circuits 9 and 10 and a driver circuit 12. The output data from the time count circuit 3, the alarm time setting circuit 4, the separate clock circuit 6, and the separate alarm setting circuit 7 are applied to a display switch circuit 14. In the display switch circuit 14, the output data from the time count circuit 3 is applied to one input terminals of AND circuits 15 and 16. The output data from the alarm time setting circuit 4 is applied to one input terminal of an AND circuit 18. The output data from the separate clock circuit 6 is applied to one input terminals of AND circuits 17 and 19 while the output data from the separate alarm time setting circuit 7 is applied to one input terminal of an AND circuit 20. A count "0" signal from a scale-of-3 counter 21 is applied as a gate control signal to the other input terminals of the AND circuits 15 and 19. A count "1" signal from the counter 21 is applied as a gate control signal to the other input terminals of the AND circuits 16 and 18. A count "2" signal from the counter 21 is applied as a gate control signal to the other input terminals of the AND circuits 17 and 20. The scale-of-3 counter 21 is progressively stepped every time it receives an operation signal of a display changeover switch S1 through a one-shot circuit 22. The count "0" and "2" signals from the counter 21 are applied to an OR circuit 23 of the display switch circuit 14. The count "1" and "2" signals from the counter 21 are applied to an OR circuit 24. The output data from the AND circuits 15 to 17 are produced from the display switch circuit 14 through an OR circuit 25 and is supplied to a first time display section 28 of a liquid crystal display unit 27. The output data from the AND circuits 18 to 20 are outputted from the display switch circuit 14 through an OR circuit 26 and is supplied to a second time display section 29 of the display unit 27. In addition to the first and second time display sections 28 and 29, the display unit 27 includes a first DUAL display section 30 disposed above the first time display section 28 for indicating the display contents of the display section 28 and includes a second DUAL display section 31 for indicating the display contents of the second display section 29 and an ALARM display section 32, both being disposed below the second display section 29. To the first DUAL display section 30 is applied a count "2" signal of the counter 21 as a display drive signal. The output signal from the OR circuit 23 is applied as a display drive signal to the second DUAL display section 31. The output signal from the OR circuit 24 is applied as a display drive signal to the ALARM display section 32.

Of switches S2 to S4 used for correcting and setting time, S2 is for selecting count time or alarm time, S3 for correcting time, and S4 for selecting a digit of time count. The operation signals from the switches S2 to S4 are applied to a switch control section 36 through corresponding one-shot circuits 33 to 35. The switch control section 36 has been supplied with the count "1" and "2" signals from the counter 21. In response to a combination of the "1" and "2" signals and the operation signal from the selection switch S2, the switch control section 36 selects and corrects one of the time count circuit 3, the alarm time setting circuit 4, the separate clock circuit 6, and the separate alarm time setting circuit 7. For example, when the count of the counter 21 is "1", the switch S2 selected either the time count circuit 3 or the alarm time setting circuit 4. The circuit selected is corrected by the place selecting switch S4 and the correcting switch S3. When the count of the counter 21 is "2", the switch S2 selects either the separate clock circuit 6 or the separate alarm time setting circuit 7 and the selected one is corrected by the switches S3 and S4.

Figure 2A:
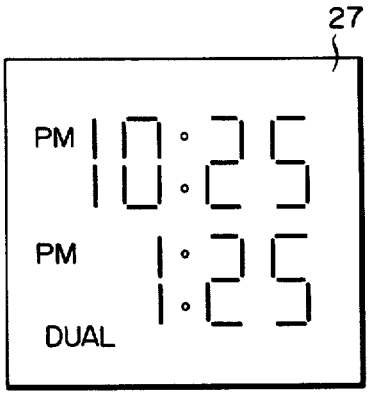
FIGS. 2(A) to 2(C) illustrates display states in a liquid crystal display unit shown in FIG. 1.
Figure 2B:
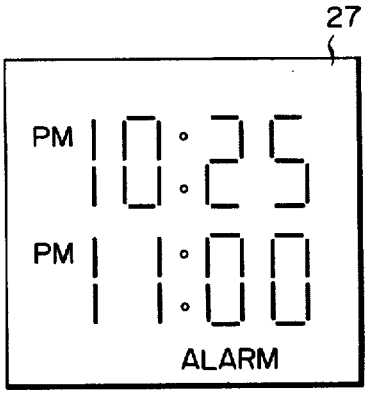

Referring to FIGS. 2(A) and 2(B) illustrating display states of the liquid crystal display section 27, when the contents of the counter 21 is "0", the counter 21 sends a count "0" signal to the display switch circuit 14. At this time, the AND circuits 15 and 19 are enabled, so that the output data from the time count circuit 3 is applied to the first time display section 28 by way of the AND circuit 15 and the OR circuit 25. The output data from the separate clock circuit 6 is applied through the AND circuit 19 and the OR circuit 26 to the second time display section 29 in the liquid crystal display section 27. The "0" signal is applied to the second DUAL display section 31 through the OR circuit 23. As a result, the liquid crystal display section 27 displays the time data from the time count circuit 3 by the first time display section 28, as "PM 10:25", for example, as shown in FIG. 2(A). The time data of the separate clock is displayed as "PM 1:25", for example, by the second time display section 29. At this time, the second DUAL display section 31 indicates that the display contents of the second time display section 29 is the time data by the separate clock circuit 6.

Then, the display changeover switch S1 is operated to render the contents of the counter 21 "1". At this time, the count "1" signal is sent from the counter 21 to the display switch circuit 14 to enable the AND circuits 16 and 18. Accordingly, the output data from the time count circuit 3 is supplied to the first time display section 28 of the liquid crystal display section 27, through the AND circuit 16 and the OR circuit 25. The output data from the alarm time setting circuit 4 is supplied through the AND circuit 18 and the OR circuit 26 to the second time display section 29 of the liquid display section 27. Further, the "1" signal drives the ALARM display section 32 through the OR circuit 24. Accordingly, in the liquid display section 27, the time data of the time count circuit 3 is displayed by the first displayed section 28. The alarm time setting data related to the major time data is displayed by the second time display section 29 as "PM 11:00", for example, and the ALARM display section 32 indicates that the display contents of the second time display section 29 is the alarm time.

Figure 2C:
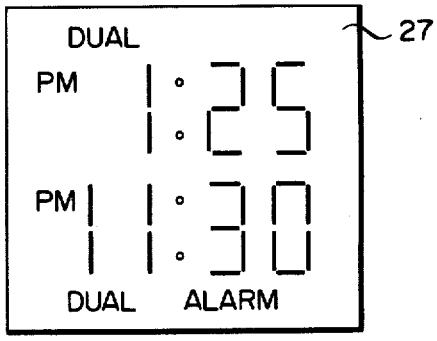

Similarly, when the counter 21 has its count "2", the count "2" of the counter 21 is applied to the display switch circuit 14 to enable the AND circuits 17 and 20. The same is applied to the second DUAL display display section 31 and the alarm display section 32, by way of the first DUAL display section 30 in the liquid crystal display section 27 and the OR circuits 23 and 24. Accordingly, in the liquid crystal display section 27, the separate time data is displayed by the first time display section 28, as "PM 1:25", as shown in FIG. 2(C). The alarm time setting data relating to the separate time data is displayed by the second time display section 29 as "PM 11:30", for example. Further, the first DUAL display section 31 indicates that the display contents of the first time display section 28 is the separate time data. The second DUAL display section 31 and the ALARM display section 32 indicate that the display contents of the second time display 29 is the alarm time setting data associated with the separate clock.

When the coincident circuit 5 finds a coincidence between the major time data of the time count circuit 3 and the alarm time setting time data (PM 11) of the alarm time setting circuit 6, it produces a coincident signal to enable the AND circuit 9. When the AND circuit 9 is enabled, it produces the frequency signal f1 from the frequency divider 11, which in turn is applied to a buzzer device 13 via the driver circuit 12. Then, the buzzer device 13 sounds an alarm sound in accordance with the frequency signal f1 of the frequency divider 11. When the coincident circuit 8 finds a coincidence between the separate time data of the separate clock circuit 6 and the alarm time setting data of the separate alarm time setting circuit 7, it produces a coincidence signal which in turn enables the AND circuit 10. Then, the AND circuit 10 produces the frequency signal f2 to be applied to the buzzer device 13 through the driver circuit 12. As a result, the buzzer device 13 produces an alarm sound in accordance with the frequency signal f2 of the frequency divider 11.

Thus, the alarm sound relating to the time from the time count circuit 3 has a timber different from the alarm sound relating to the separate time since those are different in the frequency. Therefore, an operator can know which time coincides with the related alarm time setting data by merely hearing the sound produced. While the present embodiment employs the first and second time display sections 28 and 29 in the liquid crystal display section 27, only use of the first time display section 28 is allowable. In this case, the contents of the time count circuit 3, the separate clock circuit 6, and the alarm time setting circuits 4 and the separate alarm time setting circuit 7 are displayed by the first time display section 28 in a switching manner.

Figure 3:
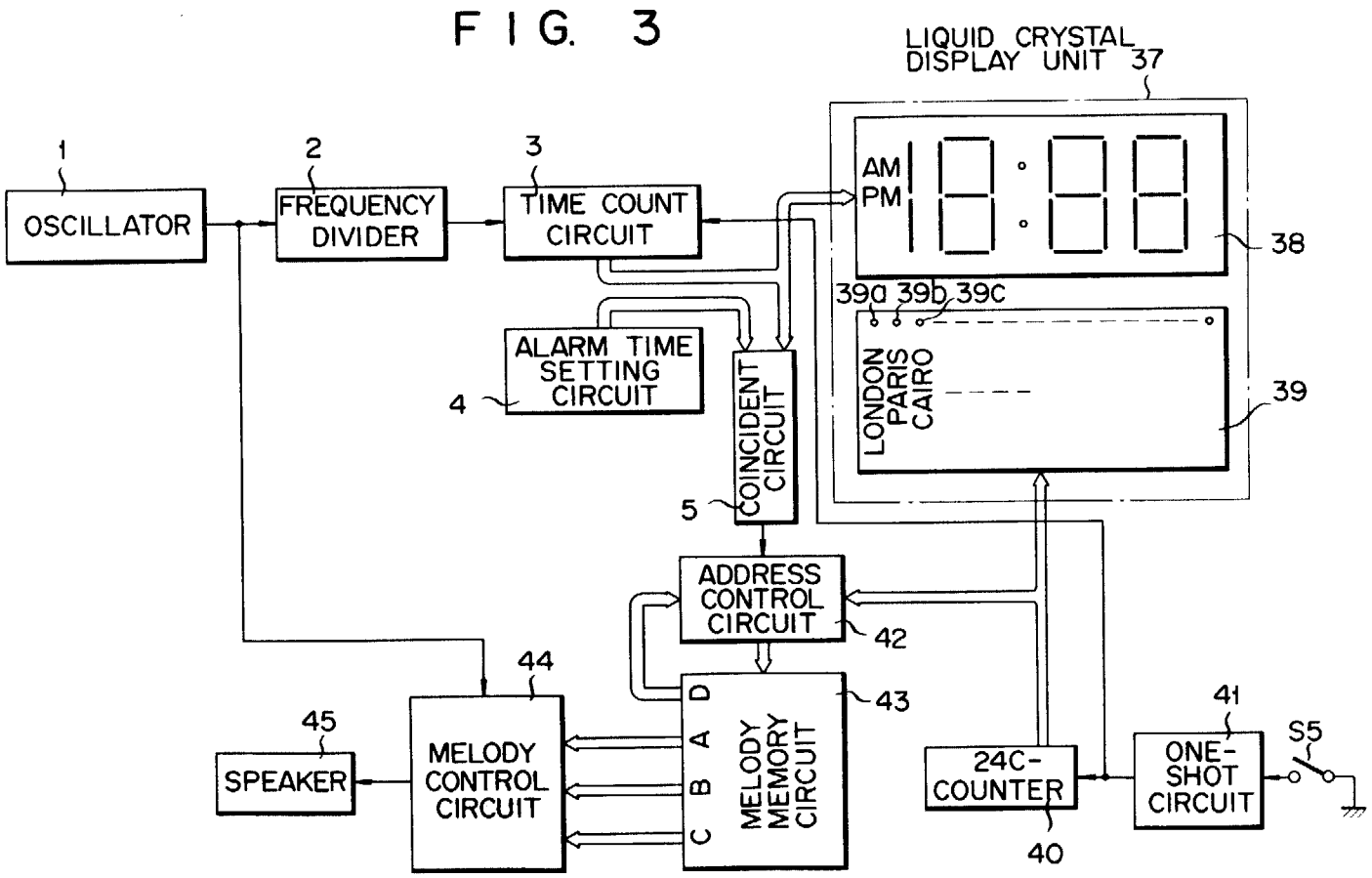
FIG. 3 shows a circuit diagram of another embodiment of the timepiece according to the present invention.

FIG. 3 shows a circuit diagram of the electronic timepiece of the another embodiment of the present invention. In FIG. 3, like symbols are used to designate like portions in FIG. 1. The output data from the time count circuit 3 is supplied to the time display section 38 in the liquid crystal display section 37 and to the coincident circuit 5 having the alarm setting time data from the alarm setting circuit 4. The liquid crystal display section 37 is further provided with city displays elements 39*a*, 39*b*, 39*c*... for displaying a city of which the time is currently displayed by the time display section 38. The city display elements 39*a*, 39*b*, 39*c*, . . . are display elements, which correspond to 24 cities different in time by one hour one from another, on the upper surface of the substrate of the liquid crystal display section 38. Those city displays elements 39*a*, 39*b*, . . . are selected by a count of a scale-of-24 counter 40 and optically displays it. The counter 40 is stepped by a one-shot pulse applied through a one-shot circuit 41 having an operation signal from the city selection switch S5. The output signal from the one-shot circuit 41 is also applied to an hour-count circuit (not shown) of the time count circuit 3. Upon receipt of the one-shot pulse, the contents of the time count circuit 3 is successively changed by +1 hour to set it to a preset time in a desired city. The contents of the counter 40 is applied as address information to the address control circuit 42. The address control circuit 42 is coupled with the coincident circuit 5. When receiving a coincident signal from the coincident circuit 5, it addresses a melody memory circuit 43, in accordance with the contents of the counter 40, which is comprised of a read only memory (ROM), for example. The melody memory circuit 43 fixedly stores 24 musical pieces relating to the 24 cities, such as national anthems of the countries of the cities or folk songs related to the regions of the cities. In the melody memory circuit 43, one of the 24 musical pieces are selected by specifying a corresponding address where the first musical sound code of the musical piece is stored by an address control circuit 42 in accordance with the contents of the counter 40. Upon the selection, the melody memory circuit 43 produces in parallel fashion a scale code A, a volume code B, a sound length code C and a signal D for specifying the next address of the memory circuit per se. The code signals A to C are applied to the melody control circuit 44 and the address specifying signal D is applied to the address control circuit 42. The melody control circuit 44 frequency-divides the basic frequency signal from the oscillator 1 to apply a sound signal depending on the code signals A to C to a speaker 45.

Accordingly, when the contents of the counter 40 is "0", the city display element 39*a* corresponding to London is driven for display to indicate that the time displayed by the time display section 38 is the present time in London. When the coincident circuit 5 detects a coincidence between the contents of the time count circuit 3 and the alarm time setting circuit 4, a coincident signal is applied to the address control circuit 42 to drive it. Then, the address control circuit 42 applies the contents "0" of the counter 40 as address data to the melody circuit 43. The melody memory circuit 43 selects a musical sound relating to London, for example, the national anthem of England, from the 24 musical pieces stored. And it produces the scale code A, the volume code B and the sound length code C which are related to the first music sounds composing the musical piece, and the next address specifying signal D as well. On those code signals A to C, the melody control circuit 44 produces given sound signals to drive the speaker 45 with the signals. As a result, the speaker 45 produces the first scale of the musical piece selected with given volume and sound length. The next address specifying signal D is applied to the melody memory circuit 43 through the address control circuit 42, so that the necessary codes A to C relating to the next musical sound are produced and the melody control circuit 44 applies the sound signal on the basis of the code signals A to C to the speaker 45. Accordingly, the speaker 45 produces the second musical sound for the musical piece. Through the repetition of the operations as mentioned above, the national anthem of England.

Then, when the city selection switch S5 is operated, the one-shot circuit 41 produces a one-shot pulse to increment by 1 the hour of the time data in the time count circuit 3 while at the same time counts up "1" the contents of the counter 40. When the contents of the counter 40 reaches "1", the city display element 39*b* is driven to indicate that the time displayed by the time display 38 is the present time in Paris. Then, the coincident circuit 5 produces a coincident signal. In response to the coincident signal, the address control circuit 42 specifies an address storing the musical piece relating to Paris stored in the melody memory circuit 43, because the counter 40 has "1". As a result, the melody memory circuit 43 successively produces the musical piece data relating to Paris. Similarly, the music pieces are produced for the remaining cities when its present times are displayed. Therefore, one can easily know the city of the time being displayed by merely hearing the related alarm sound.

While the above-mentioned embodiment is designed to produce an alarm sound at the preset time, different preset times may be employed for different regions.

What is claimed is:

1. An electronic timepiece comprising:

a source of reference clock signals; first time counting means coupled to source of reference clock signals for counting said reference clock signals to obtain time date;

second time counting means coupled to said source of reference signals for obtaining time data which is different from the time date of said first time counting means;

time data display means coupled to said first and second time counting means for displaying the time data obtained from said first and second time counting means;

first alarm time data setting means associated with said first time counting means and being selectively settable to a first alarm time;

second alarm time setting means associated with said second time counting means;

first coincidence signal outputting means coupled to said first time counting means and to said first alarm time data setting means for detecting a coincidence between the time data of said first time counting means and first alarm time data set in said first alarm time data setting means to output a first coincidence signal;

second coincidence signal outputting means coupled to said second time counting means and to said second alarm time data setting means for detecting a coincidence between the time data of said second time counting means and second alarm time data set in said second alarm time data setting means to output a second coincidence signal; and alarm informing means for receiving said first and second coincidence signals to produce a first alarm sound responsive to receipt of said first coincidence signal, and a second alarm sound responsive to receipt of said second coincidence signal, said first and second alarm sounds being different from each other and audibly distinguishable from each other.

2. An electronic timepiece according to claim 1, wherein said time display means includes means for simultaneously displaying the time data obtained from said first time counting means and the time data obtained from said second time counting means.

3. An electronic timepiece according to claim 1, wherein said time display means includes means for displaying the time data obtained from said first and second time counting means in a switching manner.

4. An electronic timepiece according to claim 1, wherein the alarm sounds produced by said alarm informing means comprise respective different musical pieces.

5. An electronic timepiece comprising:

a source of reference clock signals;

time counting means coupled to said source of reference clock signals for counting said reference clock signals to obtain time data;

time data display means coupled to said time counting means for displaying time data obtained by said time counting means;

alarm drive signal generating means coupled to said time counting means for generating an alarm drive signal when time data obtained from said time counting means coincides with an alarm time;

local district selecting means for selectively designating one of a plurality of local districts having a time differential;

time converting means coupled to said local district selecting means and to said time counting means for converting time data obtained from said time counting means to time data of the selectively designated local district; and alarm sound informing means producing different respective alarm sounds to be generated according to the selective designation by said district selecting means, when said alarm drive signal generating means delivers an alarm drive signal, said different respective alarm sounds being audibly distinguishable from each other so that alarm sounds can be audibly associated with the respective designated local districts.

6. An electronic timepiece according to claim 5, wherein the alarm sounds produced by said alarm sound informing means comprise respective different musical pieces.

* * * * *